US005484084A

United States Patent [19]

Junqueras Guerre

[11] Patent Number: 5,484,084

[45] Date of Patent: Jan. 16, 1996

[54] NON-FILLABLE STOPPER

[76] Inventor: Joaquin Junqueras Guerre, C. Riu, 27, 08291 Ripollet, Spain

[21] Appl. No.: 248,430

[22] Filed: May 24, 1994

[30] Foreign Application Priority Data

May 31, 1993 [ES] Spain ..... 9301178

[51] Int. Cl.[6] ..... B65D 47/02

[52] U.S. Cl. ..... 222/147; 215/25

[58] Field of Search ..... 222/147, 567, 222/505; 215/21–28

[56] References Cited

U.S. PATENT DOCUMENTS

| | | | |
|---|---|---|---|
| 281,611 | 7/1883 | Burnett | 222/147 |
| 1,697,112 | 1/1929 | Fernandez et al. | 215/25 |
| 1,933,646 | 11/1933 | Witt et al. | 222/147 |
| 2,270,095 | 1/1942 | Voltolini | 215/25 |
| 2,407,063 | 9/1946 | Del Llano | 215/25 X |
| 2,424,356 | 7/1947 | Gonzalez | 215/25 |
| 2,626,723 | 1/1953 | Onorato | 222/147 X |
| 3,067,897 | 12/1962 | Incera | 215/25 |
| 3,484,819 | 12/1969 | Tanner | 222/147 |
| 3,985,332 | 10/1976 | Walker | 222/147 X |
| 4,382,520 | 5/1983 | Aleff | 215/21 |

FOREIGN PATENT DOCUMENTS

| | | | |
|---|---|---|---|
| 136285 | 2/1950 | Australia | 215/25 |
| 2340256 | 9/1977 | France | 222/147 |
| 490449 | 2/1954 | Italy | 222/147 |
| 545282 | 6/1956 | Italy | 222/147 |
| 664584 | 1/1952 | United Kingdom | 222/147 |
| 886369 | 1/1962 | United Kingdom | 215/25 |

*Primary Examiner*—Kevin P. Shaver
*Attorney, Agent, or Firm*—Steinberg, Raskin & Davidson

[57] ABSTRACT

A non-fillable stopper comprises a first tubular body which fits hermetically into the mouth of the neck of a bottle, a second pouring body joined to the first body, and a third body or skirt arranged outside the neck of the bottle. The first body comprises a movement guide and a plurality of openings, and forms a first chamber which comprises a plug element which moves along the movement guide and a seated opening for the plug element. The second body forms a second chamber juxtaposed to the first chamber in which an element formed of a material which is resistant to penetration by piercing objects is situated. The second chamber and the penetration-resistant element are formed such that the penetration-resistant element is stationary and immoveable within the second chamber to prevent access to the first chamber.

6 Claims, 3 Drawing Sheets

NON-FILLABLE STOPPER

The present invention relates to an non-fillable stopper. Said non-fillable stopper is for use in bottles in which the pouring of liquids does not imply the possibility of gaining access to the interior thereof, preventing fraudulent refilling.

BACKGROUND OF THE INVENTION

The use of non-fillable stoppers as a means of protecting and ensuring inviolability of the interior of bottles is a widely known field in which innovations appear constantly. Said innovations are a result of the continuing advances in the fraudulent activities relating to the refilling of bottles containing drinks, a practice which must be prevented at all costs.

For this reason there is a great deal of documentation, references and records describing embodiments of non-fillable stoppers, among which it worth mentioning the following Spanish utility models:

U 159124 for a "Bottle closing device".

U 194560 for a "Irreversible axial coupling safety closure for liqueur bottles and other receptacles".

U 250124 for a "Arrangement to prevent fraudulent opening of non-fillable stoppers".

U 289887 for a "Bottle closing device" and patent

PE 8701859 for "Improvements in non-fillable stoppers".

These documents describe different embodiments of non-fillable stoppers, all of them with similar characteristics such as the fact that they comprise a body fitted inside the mouth of the bottle, and that they are provided with a housing in the form of a cage inside which is arranged a plug valve that tends to remain in its seat, closing the liquid outlet opening, when the bottle is upright.

Current non-fillable stoppers have demonstrated their effectiveness, but they no longer manage to prevent entirely improper tampering or the fraudulent refilling of bottles.

These current stoppers offer little protection against access by piercing elements, such as hypodermic needles, nails, etc., which makes it possible to tamper with the plug valve and eliminate its tendency to remain in its seat, thereby allowing access to the interior of the bottle.

Another known fraudulent practice is the insertion of metal pipes or tubes of small diameter at a high temperature such that they easily penetrate the various components, which are normally made of plastic, forming an opening which allows access to the interior of the bottle.

It is also known that the valve and its seat are not one hundred percent watertight, and that said watertightness can be easily overcome, since the valve oscillates and rocks in its seat, allowing access to the interior of the bottles during such rocking motion.

Finally, a common fraudulent practice is to extract entirely the assembly comprising the non-fillable stopper and the means by which it is fitted to the bottle, leaving the neck of the bottle free for fraudulent refilling.

Said practices are known and it is for this reason that non-fillable stoppers have improvements and innovations which tend on the one hand to avoid said undesirable tampering and on the other to improve the conditions of inviolability and make it more difficult to gain access to the interior of the bottles.

It is therefore also important to point out that any non-fillable stopper should provide suitable conditions regarding the inviolability and difficulty of access to the interior of the bottle, without these conditions making it too expensive to realize or difficult to carry out and without having a negative effect on normal pouring actions, in particular regarding the fluidity of pouring.

DESCRIPTION OF THE INVENTION

In order to solve the above mentioned drawbacks, the non-fillable stopper which forms the object of the present invention has been conceived.

Said stopper comprises a first tubular body or vessel which fits hermetically into the mouth of the neck of a bottle or the like, a second pouring body or element, joined to the first body, and a third body or skirt arranged outside the neck of the bottle and which fixes the other two bodies, which are connected together, to the neck of the bottle.

The first tubular body or vessel comprises a movement guide and a plurality of openings. Said first tubular body or vessel forms a first chamber which inside comprises a plug element that can move along the movement guide and a seated opening for said plug element.

The second body, connected to the first body, forms a second chamber juxtaposed to the first chamber.

The third body comprises means of fixing it to the neck of the bottle, means of joining it to the assembly formed by the first and second bodies and a cap for closing the assembly, said cap being linked to the third body by tearable means.

The non-fillable stopper which forms the object of the invention is characterized in that it comprises an element, made of a material which is resistant to penetration by piercing objects, arranged inside the second chamber in such a way that it prevents access to the first chamber.

Said element prevents and hinders piercing elements from gaining access to the interior of the stopper and therefore to the movable plug element.

Advantageously, the element which prevents access to the first chamber is a sphere, making it even more difficult for piercing elements such as hypodermic needles or nails to penetrate.

According to one preferred embodiment, the stopper is characterized in that the movable plug element comprises a cylindrical part which penetrates the opening in the seat of the plug element, fitting in said opening, when the bottle is in the rest position.

This improves the fitting of the plug element in the seat of the opening, preventing oscillating movements of the plug element.

Preferably, the cylindrical part of the plug element comprises a peripheral channel into which fits the seat of the opening.

This prevents undesirable inclinations of the plug element when it is in the position for closing the opening.

According to another embodiment, the non-fillable stopper comprises a plurality of inclined flexible elements arranged between the second body and the plurality of openings in the first chamber of the first body. Said inclined elements move in order to allow the liquid inside to come out and to prevent the entrance of liquids from the outside.

Said elements constitute a unidirectional valve of simple design and low cost.

Advantageously, the plurality of inclined flexible elements are inside the first body and arranged in such a way that they are inaccessible from the outside.

This prevents said elements from being tampered with.

BRIEF DESCRIPTION OF THE DRAWINGS

In order that the present invention be better understood, the accompanying drawings show by way of non-limiting example one practical embodiment of an non-fillable stopper according the present invention.

DESCRIPTION OF A PREFERRED EMBODIMENT

Figure 1:
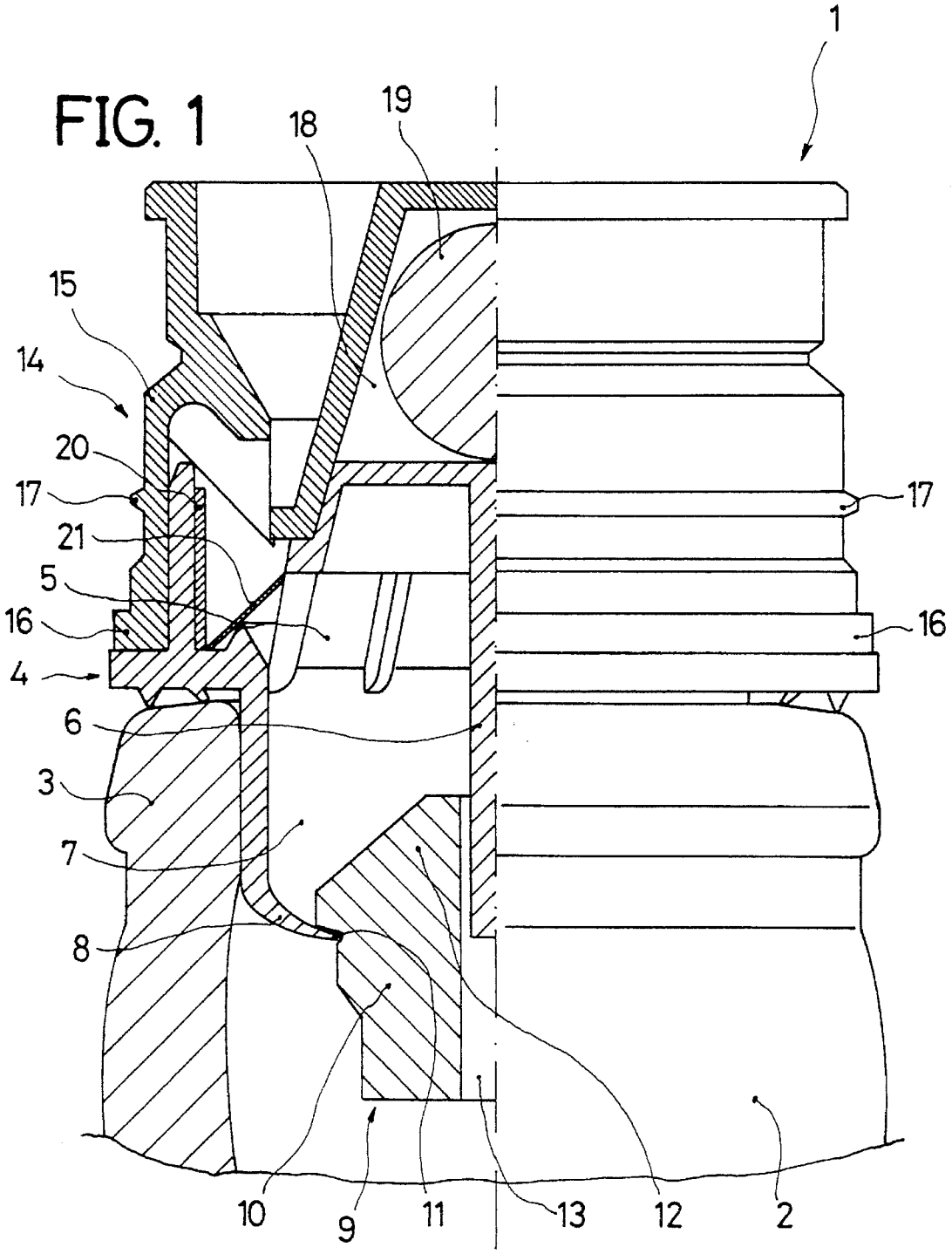
FIG. 1 is an elevation view, sectioned along its axis of symmetry, of an assembly of elements of the non-fillable stopper which forms the object of the invention, arranged on a bottle and in the closed position.
Figure 2:
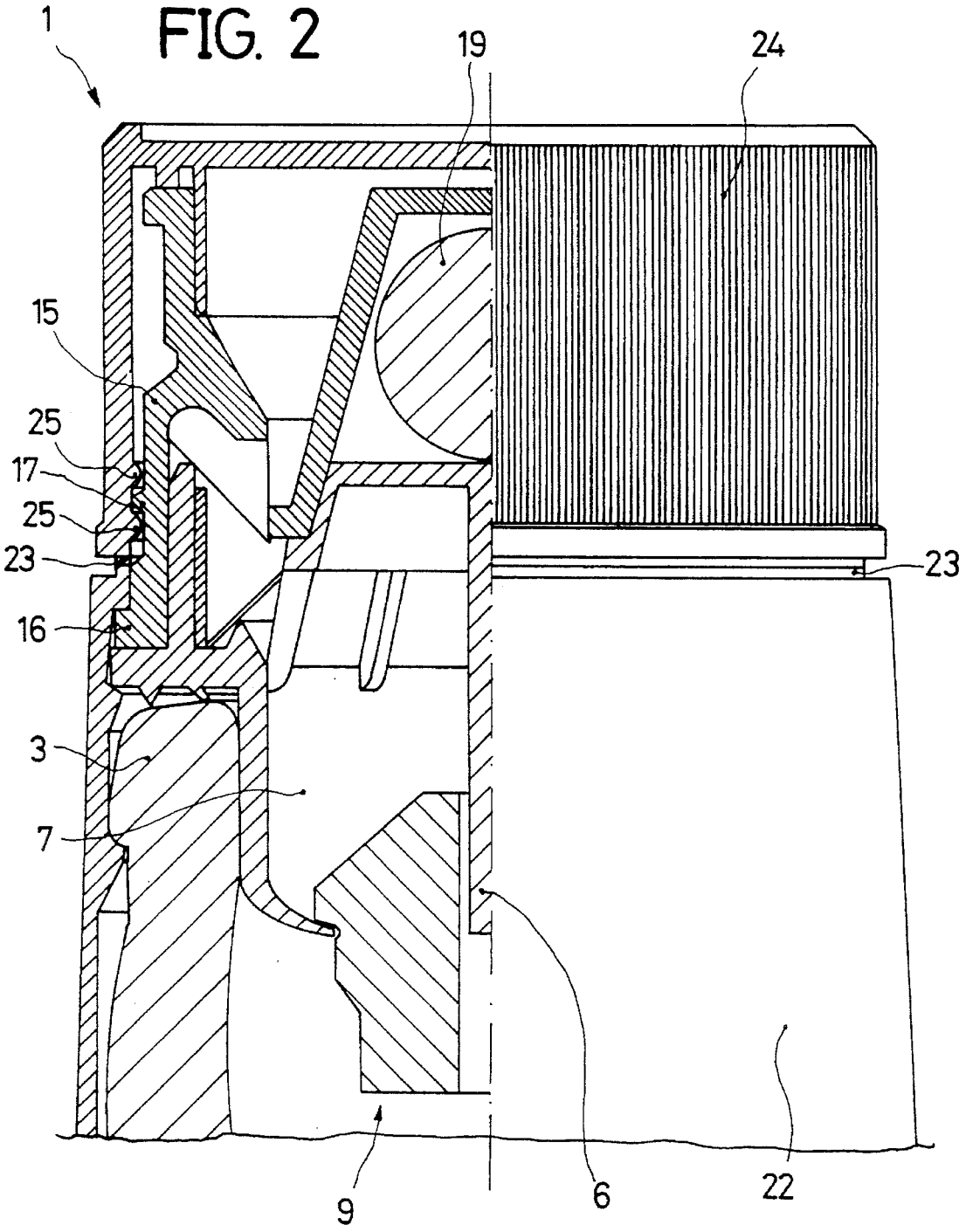
FIG. 2 is an elevation view, sectioned along its axis of symmetry, of the complete assembly of the non-fillable stopper arranged on the bottle and in the same closed position as in FIG. 1.

FIGS. 1 and 2 show an embodiment of the non-fillable stopper 1 arranged on the neck 2 of a bottle 3. Said stopper 1 comprises a first body 4, comprising a number of openings 5 and a guide rod 6, all moulded in a single piece and forming a chamber, known as the vessel 7, which is housed inside the neck 2 of the bottle 3. The vessel 7 is provided in its lower part with a seated opening 8 for the passage of liquid.

A valve 9 is provided inside said vessel 7, said valve comprising a cylindrical body 10, which fits by means of a peripheral channel 11 in the seated opening 8, and a head 12 whose diameter is larger than the cylindrical body 10 and therefore larger than the seated opening 8. Said valve 9 further comprises a central hole 13 through which the guide rod 6 can pass.

The non-fillable stopper further comprises a second body known as the pourer 14 which, being moulded in a single piece, comprises an outer cylinder 15 with various protruding ribs 16, 17, being connected to the first body 4 and positioned above the neck 2 of the bottle 3 and forming, together with the first body, another chamber 18, tronco-conical in shape, in which is located a sphere 19.

A ring 20 with inclined flexible elements 21 is arranged between the two bodies 4 and 14, said elements resting, in their normal position, against the various openings 5 of the body 4 and preventing the passage of liquid from the outside, and being able to bend away from said openings 5 when the liquid comes from the body 4.

Finally, said stopper comprises a ring known as the skirt 22 which, being fixed to the outside of the neck 2 of the bottle 3 and being joined to the ribs 16 of the outer cylinder 15 of the pouring body 14, which is in turn joined-to the body 4, secures and fixes the elements of the stopper to the neck 2 of the bottle 3.

In a non-permanent way by means of a tearable ring 23, said skirt forms an integral part of a closing cap 24 which in turn is provided with a number of ribs 25 by which it is coupled to the rib 17 of the outer cylinder 15.

Figure 3:
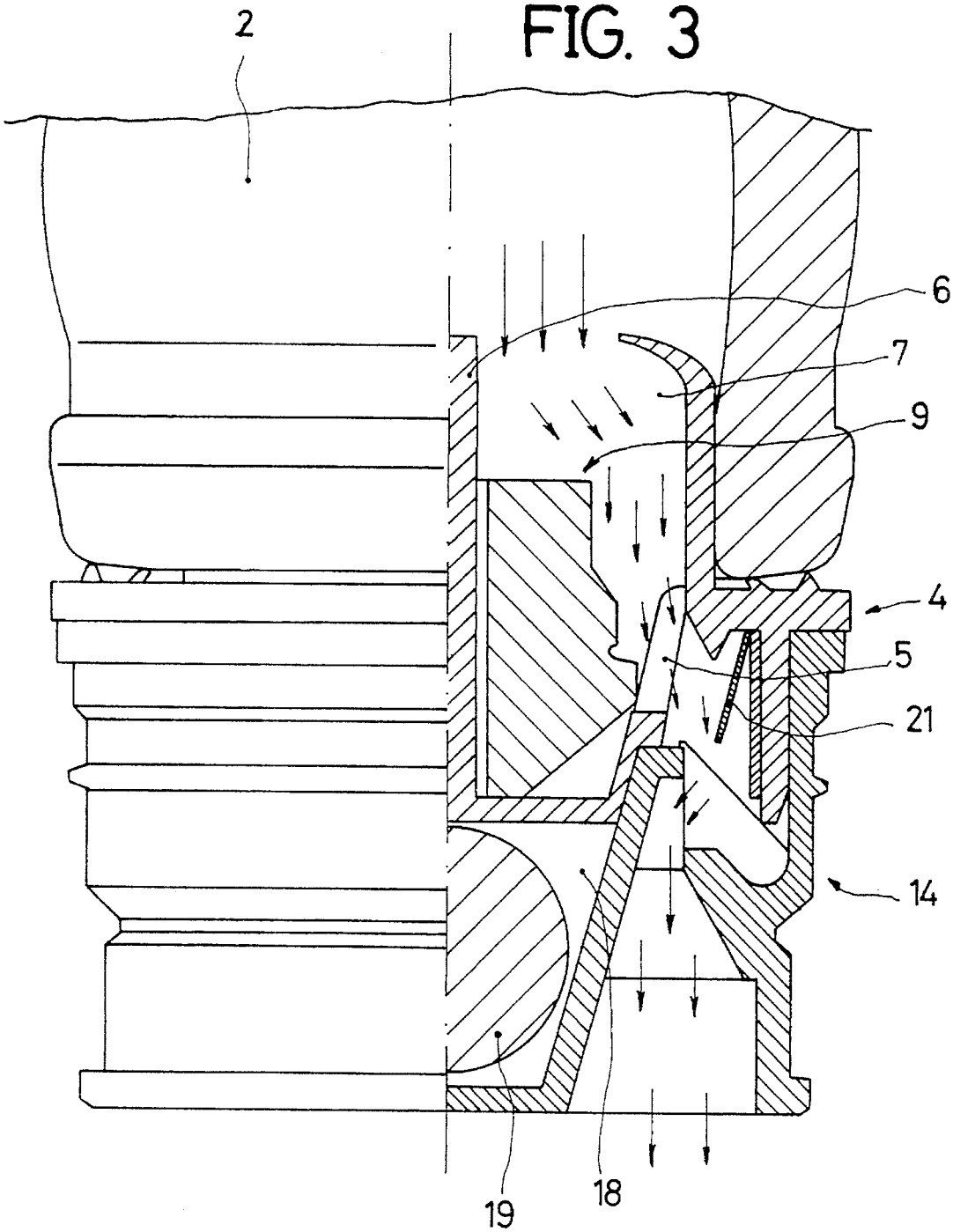
FIG. 3 shows the assembly of elements of FIG. 1, arranged on the bottle and in the position in which liquid from inside the bottle can flow out.

The arrangement of the elements of the non-fillable stopper enables liquid to leave the bottle 3 by removing the closing cap 24 and placing said bottle 3 in a position for pouring the liquid, as shown in FIG. 3. The valve 9 moves along the rod 6, due to the effect of gravity, until it reaches the end of the body 4. The liquid from inside the bottle 3 enters the vessel 7 and passes through the openings 5, pressing against the flexible elements 21 and bending them so as to allow the liquid to flow outside via the pouring element 14.

Furthermore, the same arrangement of the elements of the stopper prevents the bottle from being refilled.

The sphere prevents piercing elements from penetrating inside the vessel 7 since, as it is free inside the chamber 18 and being made of hardened materials and having no static surfaces, it makes it difficult or impossible for a piercing element to penetrate via the space defined by the chamber 18.

The inclined elements 21 are inaccessible from the outside and prevent the passage of liquids from the outside to the inside of the bottle 3 should the operation of the valve be violated.

Finally, the possible refilling of the bottle by means of shaking or oscillating movements is prevented since said valve arranged in the seated opening 8 has a design which produces a stable and watertight seal with said opening.

A concrete embodiment of the invention has been described by way of example, although the non-fillable stopper which forms the object of the invention is subject to numerous modifications and variations, obvious to an expert in the field, which should be considered as included within the Scope of the inventive concept and of the accompanying claims.

I claim:

1. A non-fillable stopper, comprising:

a first tubular body which fits hermetically into the mouth of the neck of a container with said first body comprising a movement guide and a plurality of openings, said first tubular body forming a first chamber comprising a moveable plug element which moves along said movement guide and a seated opening for said plug element;

a second pouring body joined to the first body forming a second chamber juxtaposed to the first chamber;

a third body comprising means for fixing said third body to the neck of the container and means for joining said third body to the assembly formed by the first and second bodies;

an element formed of a material resistant to penetration by piercing objects which is arranged inside the second chamber; and wherein said second chamber and penetration-resistant element are formed such that said penetration-resistant element is stationary and immoveable within said second chamber and such that said penetration-resistant element prevents access to the first chamber.

2. A stopper according to claim 1, wherein the element which prevents access to the first chamber is a sphere.

3. A stopper according to claim 1 wherein the moveable plug element comprises a cylindrical part which penetrates the opening in the seat of the plug element, fitting in said opening, when the container is in the rest position.

4. A stopper according to claim 3, wherein the cylindrical part of the plug element comprises a peripheral channel into which fits the seat of the opening.

5. A non-fillable stopper, comprising:

a first tubular body which fits hermetically into the mouth of the neck of a container with said first body comprising a movement guide and a plurality of openings, said first tubular body forming a first chamber comprising a moveable plug element which moves along said movement guide and a seated opening for said plug element;

a second pouring body joined to the first body forming a second chamber juxtaposed to the first chamber;

a third body comprising means for fixing said third body to the neck of the container and means for joining said third body to the assembly formed by the first and second bodies;

an element formed of a material resistant to penetration by piercing objects which is arranged inside the second chamber; and a plurality of inclined flexible elements arranged between the second body and the plurality of openings in the first chamber of the first body, said inclined elements moving in order to allow the liquid inside to come out and to prevent the entrance of liquids from the outside.

6. A stopper according to claim 5, wherein the plurality of inclined flexible elements are inside the first body and arranged in such a way that they are inaccessible from the outside.

* * * * *